US005553391A

United States Patent [19]

Bakalar

[11] Patent Number: 5,553,391

[45] Date of Patent: Sep. 10, 1996

[54] METHOD AND APPARATUS FOR HEAT TREATING WEBS

[76] Inventor: Sharon F. Bakalar, 510 Regenhard Ave., Moorestown, N.J. 08057

[21] Appl. No.: 462,755

[22] Filed: Jun. 5, 1995

[51] Int. Cl.[6] ..... F26B 11/02

[52] U.S. Cl. ..... 34/110; 34/273; 431/328

[58] Field of Search ..... 34/110, 273, 266; 431/328

[56] References Cited

U.S. PATENT DOCUMENTS

| | | | |
|---|---|---|---|
| 1,479,819 | 1/1924 | Kluever | 34/273 |
| 2,225,166 | 12/1940 | Erby . | |
| 2,526,906 | 10/1950 | Schaab et al. . | |
| 2,987,305 | 6/1961 | Calhoun . | |
| 3,073,038 | 1/1963 | Dapses | 34/110 |
| 3,492,741 | 2/1970 | Witworth . | |
| 3,695,818 | 10/1972 | Mizutani | 431/328 |
| 3,751,213 | 8/1973 | Sowards | 431/328 |
| 4,304,985 | 12/1981 | Miller | 34/110 |
| 4,498,864 | 2/1985 | Roth . | |
| 4,688,335 | 8/1987 | Krill et al. . | |
| 4,693,015 | 9/1987 | Hemsath et al. . | |
| 4,722,681 | 2/1988 | Smith . | |
| 5,276,327 | 1/1994 | Bossen et al. . | |

OTHER PUBLICATIONS

"Gas Infrared's Steady Success in Paper Drying" Natural Gas Applications in Industry—Spring 1994, pp. A4–A7.

"Heat Transfer Dynamics"—T. M. Smith—TAPPI Journal vol. 77 No. 8—pp.239–245.

*Primary Examiner*—John T. Kwon

[57] ABSTRACT

The disclosed cylinder for heat-treating a web is rotatable about a horizontal axis and is heated by one or multiple stationary infrared burners that extend all along the length of the cylinder, but which are limited to an arcuate extent, establishing a maximum cylinder heat output when the burner(s) is (are) supplied with air-fuel mixture at their maximum rate. Reduction of the air-fuel supply rate over a wide range allows the cylinder heat output to be reduced as the web processing speed is reduced. When the burner is divided into segments, the temperature profile along the cylinder; i.e., across the width of the web, can be regulated to adjust the moisture profile of the web. An exhaust manifold within and along the cylinder is configured so as to avoid any local accumulation of high-temperature exhaust.

21 Claims, 4 Drawing Sheets

METHOD AND APPARATUS FOR HEAT TREATING WEBS

The present invention relates to heated rotary cylinders for treating webs of material. The invention is described below as it applies to paper making apparatus, because the novel aspects have particular value in that context. However, in some respects the invention is applicable to other apparatus in which a web of material is heated by contact with a heated cylinder.

BACKGROUND OF THE INVENTION

The Fourdrinier process of paper making involves a succession of phases. Initially a slurry of cellulose fibers in water is distributed on a screen and some of the water is drained off. A web is formed which undergoes a press treatment in which the web is transported by a felt or a succession of felts to pass sinuously around a series of cylinders. Nip rollers in the press section force the felt against the formed web which, in turn, is pressed against the cylinders, to extract water mechanically. In current practice, the web leaving the press section contains from 35 to 45% solids. The web is then carried by felts into a dryer section consisting of heated cylinders, in which the water content of the web is reduced by evaporation to roughly that of the finished paper.

Afterdryers and calenders often follow the dryer section, ending with the reel. The dryers and afterdryer sections may contain 60 or more heated cylinders. A felt is used to hold the paper firmly against many of the heated dryer cylinders, for assuring contact of the web with the heated surface and thereby promoting drying efficiency.

In the dryer, the temperature of the first series of cylinders is comparatively low but it increases along the series of cylinders; the following series of cylinders effect a constant rate of drying. In this region the cylinders' temperature is uniform. At the end of the drying section, the temperature of the steam in the successive cylinders is increased to 187° C. (370° F.), for example, and the drying rate declines progressively. It is complicated and expensive to provide steam at a pressure such that a specified high temperature is maintained in each of the cylinders. This is especially true when temperature changes are to be made.

Steam-heated cylinders are massive, both because of their large size and substantial wall thickness. They ewe usually made of gray cast iron for economy, and their walls are quite thick; e.g., 25 mm. to 51 mm.(1" to 2") or more, to withstand the high internal steam pressure. A web may be 7.6 m. (25 ft.) wide, requiring corresponding long cylinders. The web may travel at 1000 m./min. (3300 ft./min.), or roughly 60 km./hr. (37 miles/hr.). That speed is impressive. By any standard, the capital investment in a paper making machine is huge, and a considerable amount of space is needed.

Various types of paper making apparatus differ from that outlined above. For example, the "Yankee" type is characterized by inclusion of one very large diameter dryer cylinder; e.g., a diameter of 3.6 m. to 5.5 m. (12 ft. to 18 ft.). There, the wall thickness is particularly great, to withstand the pressure of the contained high-temperature steam and to allow for periodic grinding to restore surface smoothness.

The highest temperature of any steam-heated cylinder is limited by the corresponding pressure of steam that can be safely contained within the cylinder. The maximum internal steam temperature of a dryer cylinder is approximately 187° C. (370° F.) because of the steam pressure limitation. It has been widely recognized that higher regulated temperatures, if feasible, would accelerate the drying process and would reduce substantially the number of dryer cylinders required. This is achieved here by replacing a large number of steam-heated cylinders in the more common type of paper making machine by a smaller number of novel cylinders heated to higher temperatures. Alternatively, using higher-temperature cylinders pursuant to the invention, a paper making machine having many cylinders could be operated at much higher speed, for greatly increased output.

Paper machine drying sections, worldwide, are almost universally heated by steam under pressure. Accordingly, it is appropriate to consider such apparatus in further detail, as a basis for appraising the advance in the art represented by the present invention.

As noted above, the temperature of a drying cylinder in a paper making machine is not determined by that which would be desirable from the point of view of performance, but by the limitations of cylinders heated by steam under pressure. This is evidenced by the large numbers of drying cylinders required in high-speed paper making machines or by the limited machine speed with lower temperature cylinders performing the drying function. Cylinders heated by steam under pressure have other significant limitations.

It is virtually impossible to regulate the temperature of a cylinder wall from point-to-point along its length, for developing a desired temperature profile across the width of a web being dried. Complicated, cumbersome arrangements have been proposed in an effort to compensate for increasing or declining temperatures at the margins of the web. However, no way has been found for adjusting the temperature profile of a cylinder heated by steam under pressure.

The external surface of a steam-heated cylinder responds slowly to an adjustment in steam pressure. This slow response time is manifested, for example, by the many minutes needed to bring the paper making machine from a cold start to full-speed operation. It is also manifested by the delayed change of a cylinder's external temperature in response to an adjustment in steam pressure.

The foregoing and other characteristics of a paper making machine whose dryer cylinders are heated by steam under pressure are impaired by some of the traits of the cylinder wall. Transfer of heat from the steam to the outer surface of the cylinder which contacts the web is impeded by many factors, including:

a) The considerable thickness of the cylinder wall needed for containing steam under the high pressure corresponding to the steam temperature, noting that the actual wall thickness is greater by a safety factor of 2.8 than that theoretically required for withstanding the steam pressure;

b) The poor heat conductivity of gray cast iron, the customary metal chosen for the cylinder wall, rather than a more expensive metal of superior heat conductivity;

c) A layer of condensate that forms and is distributed by centrifugal force over the cylinder's interior;

d) A layer of scale that develops over the cylinder's internal surface; and e) A temperature drop required to extract heat from the steam, by condensation.

The difference between the temperature of the steam and that of the cylinder's external surface represents a waste of energy.

The enormous mass of the cylinder wall and the high inertial load require a large value of installed horsepower capacity and a correspondingly high energy cost to drive the machine.

The above factors that impede energy transfer, plus the thermal inertia of the massive cylinder wall, contribute to a long response time of steam-heated cylinders. The same factors limit the speed and productivity of the machine.

Recognition of the problems and limitations of steam as the heat source in dryers of paper making machines has prompted proposals of alternative heating media.

It has been proposed that dryer cylinders in paper making machines should be heated internally by electric power; but electricity is inordinately expensive.

It has also been proposed that a dryer cylinder for paper making apparatus should be heated by a flame within the cylinder. Transfer of heat from the gaseous combustion products to the cylinder requires extensive areas of metal exposed to the hot gases and requires efficient removal of the combustion products after their heat has been extracted, so as to provide necessary space that is to receive newly emitted gaseous exhaust. See Hemsath, U.S. Pat. No. 4,693,015 issued Sep. 15, 1987 and Calhoun U.S. Pat. No. 4,498,864 issued Jun. 6, 1961.

Still further, U.S. Pat. No. 4,688,335 issued Aug. 25, 1987 to Krill et al discloses use of a gas-fired radiant heat generator to heat a cylinder that acts on a web of fibers being pressed against the cylinder by a felt and a nip roller, the web having a large water content. The heater of Krill et al is in the form of a ceramic fiber matrix shaped as a cylindrical shell. An air-fuel mixture is supplied to the interior of the shell. The mixture burns as it emerges everywhere from the shell, heating the matrix. Unlike Hemsath, above, the energy of combustion in Krill et al is intended to produce radiant heat. The heated web-engaging cylinder in Krill et al operates at 315° C. to 427° C. (600° F. to 800° F.), being so hot that some of the free water that is present in spaces between the fibers of the web is converted to steam, which blasts other free water through and out of the web. This process is called "impulse drying". Even though the supplied air-fuel mixture is adjustable, reduction of the air-fuel supply is limited by the lowest rate needed to sustain combustion. Noting that the type of heater used in Krill at al to produce radiant heat is in the form of a complete cylinder, the heat output would almost certainly be excessive for use in the usual drying section of a paper-making machine, even with its air-fuel supply adjusted downward to a minimum. Moreover, if the temperature of the cylinder were reduced by adjusting the supply of air-fuel mixture for developing a suitable operating temperature at full-speed operation of the apparatus, little if any latitude of downward adjustment would be available for realizing still lower cylinder temperatures as is required during slowed operation of the apparatus.

Despite alternatives that have been proposed for heating the dryer cylinders of apparatus for making paper, steam under pressure continues to be the generally accepted heating method.

SUMMARY OF THE INVENTION

A broad object of the invention resides in providing novel heated cylinders. Those cylinders have various applications, but they have attributes of distinctive importance in paper making apparatus. In one aspect of the invention, the heated cylinders rotate; a web of material is heat-treated as it passes partway around each cylinder. The cylinder has a horizontal rotary axis. A stationary core in the cylinder includes gas-fired infrared generators or IR burners which extend along the cylinder but which subtend only an arc or arcs of the cylinder's interior. The radiant heat of the IR burners is absorbed instantly and directly by that portion of the cylinder which is momentarily confronted by the IR burners. In operation, the cylinder rotates constantly, exposing the entire inner surface of the cylinder to radiant heat. Thus, the cylinder is heated uniformly.

The provision of IR burners extending all along the cylinder but which have only a limited arcuate extent is an aspect of the invention that has profound implications. It makes possible the construction of a cylinder that develops a specified maximum operating temperature, and in like manner it makes possible the construction of a succession of cylinders having either the same specified operating temperature or specified operating temperatures that differ, rising or declining cylinder-to-cylinder, as may be required in treating a web of material.

Each novel cylinder (and multiple cylinders of a machine) has the capacity of being operable over a wide range of temperatures, downward from a maximum, or upward to a maximum, by adjusting its supply rate of air-fuel mixture. This attribute is important in the dryer cylinders of paper making machines, particularly when reducing the operating speed from an established norm and when increasing the speed to the established norm.

IR burners of a novel cylinder are supplied with a combustible air-fuel mixture, ordinarily a stoichiometric mixture of air and fuel. IR burners typically have the distinctive property of converting a large fraction of their energy of combustion into infrared radiation; this is in prominent contrast to burners that rely on transfer of heat by contact of hot combustion gases with surfaces to be heated. Various forms of IR burners are known, including those which have porous ceramic panels, porous sintered metal panels, metal mesh panels, and even ceramic tile plates having a pattern of discrete passages. The form of IR burners that is best suited to the present purposes is that which is based on the technology of a long series of patents issued to Thomas M. Smith; e.g. U.S. Pat. No. 4,722,681, issued Feb. 2, 1988. Such IR burners involve a panel comprised of a porous matrix of ceramic fibers and a binder. The matrix preferably contains material such as silicon carbide particles to enhance the infrared output efficiency of the burners.

IR burners are operable over a range of supply of air-fuel mixtures. Throughout the range of supply variations, the combustion occurs at or just inside the exit face of the gas-permeable panel, heating the surface of the panel to incandescence. When the rate of supply exceeds the maximum, the combustion lifts away from the exit surface of the panel; when the supply drops below a minimum the combustion tends to recede toward the supply face of the gas-permeable panel and combustion ceases. There is a possibility of the burner backfiring; i.e., ignition of the combustible supply may occur behind the burner's panel. The matrix components in the Smith patents are chosen to inhibit backfiring.

Characteristically, the heat output of an IR burner of any particular construction is dependent directly on its area. Increasing the heat output of any given IR burner is achieved by increasing its supply rate of combustible mixture up to a maximum rate. IR burners are usually operable to produce adjustable rates of heat output. It is important to be able to turn down the temperature and heat output of a cylinder and its IR burners correspondingly, for example, when the paper making apparatus is slowing down.

As will be seen, there are conditions when the supply to an IR burner is adjusted somewhat for changing its heat output while the apparatus is in full speed operation. However, it is desirable to reserve most of the turn-down adjustment capability of the cylinder's IR burners for use when the speed of the apparatus is to be reduced. Accordingly, the designation of the area of the cylinder's complement of IR burners should be related to its maximum or near-maximum rate of air-fuel supply. This, in turn, is accomplished by designating the arcuate extent of its IR burners of any particular design and efficiency. The term "complement of IR burners" and "IR burner complement" means all of the IR burners with which a cylinder is equipped. The term "arcuate" signifies around the cylinder; "extent" signifies a linear dimension, not a number of degrees, so that "extent" refers to the width of the IR burners, or to their combined widths if multiple rows of IR burners are used.

IR burners can be made in the form of multiple sections. Each burner may have its own air-fuel supply regulator. However, even though multiple-section burners are used to advantage in the illustrative embodiment of the invention below, it is also feasible to utilize IR burners that are other-than-sectional. In concept, one or more very long IR burners extending along the cylinder may be used, as appropriate, instead of a row of many sectional IR burners.

Another object of this invention resides in utilizing IR burners made in sections to regulate the temperature of some parts of a drying cylinder selectively, to match or be different from sections at other parts of the cylinder, for developing a desired "temperature profile" across the width of the web being treated. In particular, the temperature of the ends of a cylinder may have a tendency of tapering down, due to lessened heater-to-cylinder heat transfer or due to greater heat losses at the cylinder's ends. Different IR burner sections may be chosen or designed in advance to compensate for any anticipated temperature deviations, especially declines in temperature at the cylinder ends. This compensation may also be achieved during operation by limited adjustment of the air-fuel mixture supply to the sectional IR burners at the ends of the cylinder or elsewhere as needed. However, as already noted, it is desirable to reserve most of the range of adjustment of the IR burners' air-fuel supply for use when the speed of the apparatus is being changed.

Equipping drying cylinders with sectional IR burners having separate air-fuel supply regulators affords an excellent means for developing desired profiles of heat output across the width of the web. The apparatus may include a sensor or a scanning sensor cooperating with a portion of the web opposite each burner module inside the cylinder. Each sensor or the scanning sensor responds to the moisture content of the web downstream of the cylinder. The sensor or sensors regulate the supply of the air-fuel mixture to individual modules for maintaining a specified moisture content at that portion of the width of the web.

A further object of the invention resides in providing an exhaust duct of a configuration aimed at avoiding the build-up of hot exhaust gas such as might distort the temperature profile of the cylinder. This is of particular concern in paper-making apparatus having cylinders that are very long. Recognizing that IR burners radiate a prominent portion of the heat resulting from combustion, nevertheless the exhaust gas of IR burners is significantly hot. In a horizontal cylinder heated by IR burners extending end-to-end within the cylinder and having a limited arcuate extent, an arcuate space remains in the cylinder which is not occupied by IR burners. In achieving the above object of the invention, an exhaust duct extending end-to-end in the cylinder is located above the IR burners. The exhaust gas from the IR burners is strongly impelled upward by its buoyancy. The configuration of the exhaust duct is devised to counteract any tendency of the exhaust gas to develop higher temperatures at some regions along the cylinder than others.

A still further object of the invention resides in providing a cylinder heated by longitudinally disposed IR burners of limited arcuate extent, with means to conserve heat initially absorbed by portions of the cylinder while opposite the IR burners. After a portion of the cylinder that has just been heated leaves the IR burners, the newly heated area of the cylinder radiates heat towards the cylinder's interior. Pursuant to the just-mentioned object of the invention, heat-absorbing shields are placed all around the cylinder's interior in regions not occupied by the IR burners or the exhaust duct. These shields become hot and, as such, reradiate heat outward, toward the cylinder, where the reradiated heat is again absorbed by the cylinder.

The heat shields have a further function in the novel cylinder heated by the IR burners. There is a radial clearance space between the rotating cylinder wall and the stationary shields. That space constitutes a passage for the hot exhaust gases emitted by the IR burners; the shields direct the buoyant exhaust to the exhaust manifold. The buoyancy is uniform at all points along the cylinder, thus providing an effective means for removing exhaust gas from the burners, uniform along the length of the cylinder.

The novel cylinders, with their IR burners, have many prominent advantages over cylinders heated by steam, as is customary in the drying section of paper-making machines. Unlike cylinders heated by steam under pressure, where the maximum temperature is limited in practice by the safe pressure-resisting thickness of the cylinder wall, the temperature attainable by the novel cylinder is in no sense limited by the wall thickness of the cylinder. The wall of the novel cylinders may be comparatively thin and lightweight, consistent only with its mechanical requirements; and it may be made of a metal chosen for superior thermal conductivity. The IR burners can be adjusted rapidly to change the cylinder's operating temperature, and the cylinder wall does not appreciably retard the transfer of heat from the burners to the external surface. The comparatively thin and lightweight cylinders save installed horsepower and driving energy consumption. The IR burners that extend end-to-end along the novel cylinder may comprise sectional burners, whose air-fuel mixture may be regulated selectively to provide the desired temperature profile across the width of the web being heated, a result not attainable with steam-heated cylinders. The novel cylinders are unencumbered by all the problems and consequences of condensate which characterize steam-heated cylinders. The cost and maintenance of high-pressure steam valves are eliminated. The novel cylinders enable the reduction of the required number of cylinders heretofore heated by steam under pressure, or an increase in the speed and productivity of a paper making machine, or both a reduction in the number of cylinders and an increase in speed.

The following detailed description and accompanying drawings represent two illustrative embodiments of various aspects of the invention. While these embodiments are described as the invention is applied to paper making machines, some of the novel aspects are applicable to machines for treating webs of other materials. Additionally, it is apparent that some aspects of the invention may be used without others; substitutions and modifications will be readily apparent to those skilled in the art. Consequently, the invention should be construed broadly, in accordance with its true spirit and scope.

ILLUSTRATIVE EMBODIMENTS OF THE PRESENT INVENTION

Figure 1:
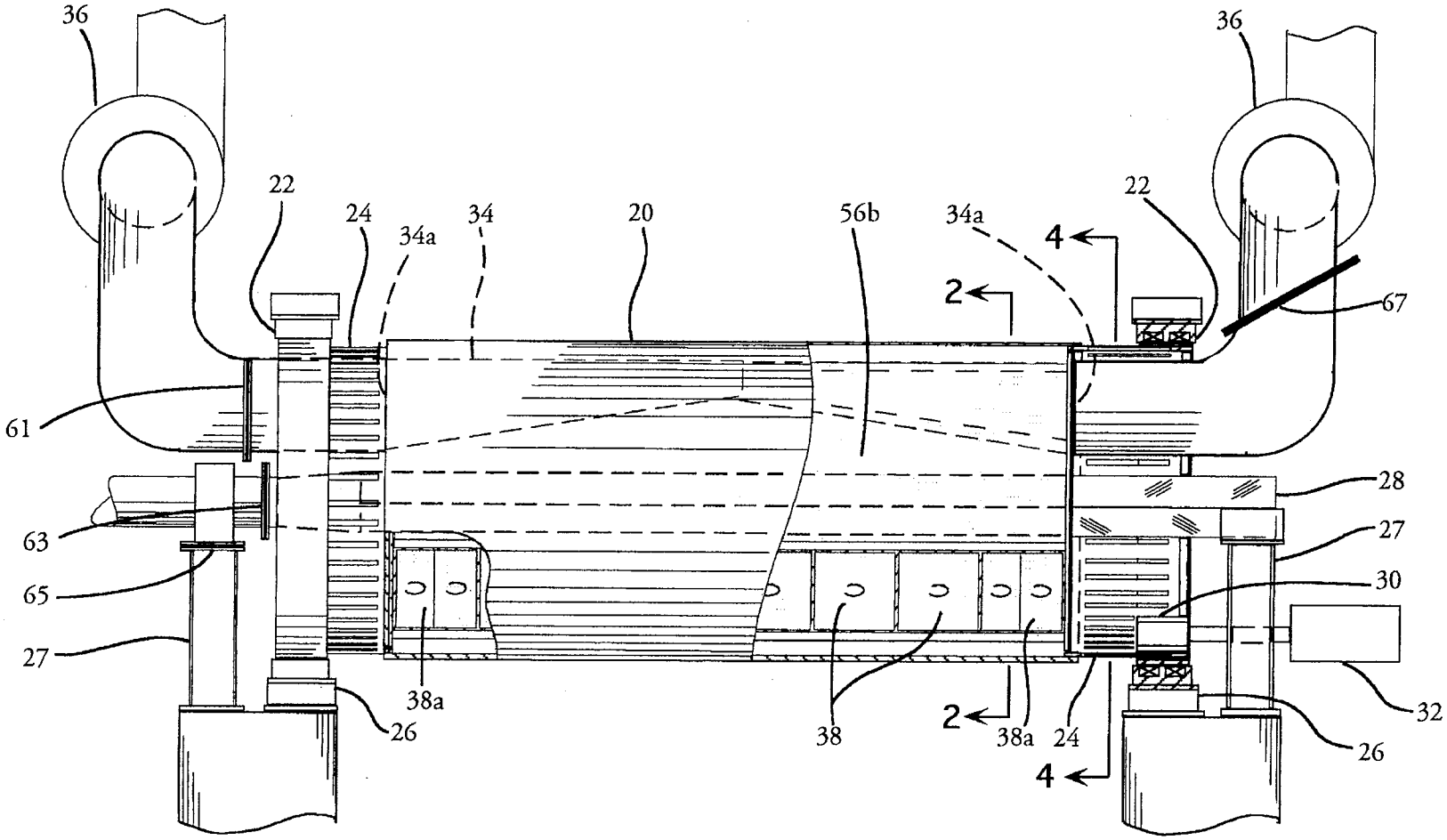
FIG. 1 is a lateral view, partly in cross-section, of a dryer cylinder, being an illustrative embodiment of the present invention.

A novel heated cylinder is shown in FIG. 1, useful particularly in the dryer section of paper making apparatus. In FIG. 1, cylinder 20 is supported at its opposite ends by bearings 22 which may be as large as the cylinder's diameter. Cylinder 20 has a relatively thin wall and is made of metal chosen for superior thermal conductivity, for example an aluminum bronze alloy. Collars 24 extend from the ends of cylinder 20 to the inner races of bearings 22 to support the cylinder. The collars have a pattern of slots or other cut-out shapes to provide some heat isolation between cylinder 20 and its supporting bearings 22. Conventional cooling means (not shown) may be provided for the bearings. Frame members 26 at the ends of the cylinder support the outer races of bearings 22, and frame plates 27 support the ends of an axial tube 28 extending along the cylinder's axis. Tube 28 in this embodiment serves two purposes. It is a structural support for the entire stationary assemblys (FIGS. 1 and 2) located in the cylinder's interior; and it is a conduit for the air-fuel supply. The inner race of each bearing 22 is formed as a ring gear 29, to be driven by pinion 30 and motor 32. This drive is a diagrammatic representation of a drive means for rotating cylinder 20. In an entire drying section, a more sophisticated drive is contemplated, such as that used in practice for coordinately turning all of the cylinders in processing a continuous paper web.

Extending along the top of cylinder 20, inside the cylinder, is an exhaust duct 34 having dual exhaust exits 34*a* at the ends of the cylinder. IR burner modules 38 (collectively an "IR burner") produce exhaust gases which are drawn out of the duct by exhaust blowers 36.

Figure 3:
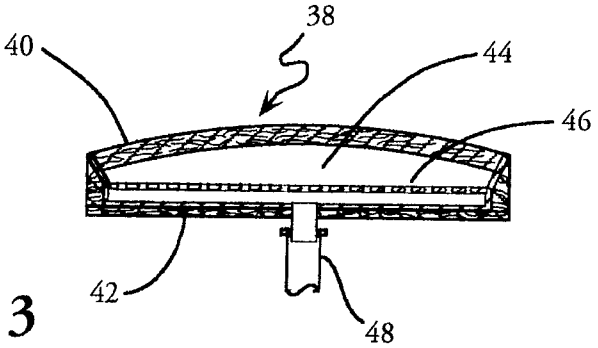
FIG. 3 is a portion of FIG. 2 drawn to still larger scale.

An IR burner module 38 in FIG. 3 is of any suitable light-weight design like those in U.S. Pat. No. 4,722,681 (supra). It comprises a gas-permeable matrix 40 of ceramic fibers and a binder, whose composition may be varied as described in the '681 patent incorporated here by reference. A rear wall 42 of metal externally covered by insulation is sealed to the edges of the matrix, forming an intake plenum 44. The plenum is divided by a partition 46 having apertures enabling the air-fuel mixture from inlet connector 48 to reach the inner baffled compartment of the plenum; i.e., the compartment located above the partition in FIG. 3. The air-fuel mixture passes through the matrix and it burns as it emerges, heating the surface of the matrix to incandescence. The matrix can be loaded with silicon carbide particles to improve the IR emissivity of the panel.

No novelty is asserted here for this or any particular form of IR burner; the drawing and this description are provided for identifying IR burners as distinguished from air-fuel burners that are relied on primarily to emit heated gaseous products of combustion. Ideally the outer surface of the matrix is cylindrically curved as shown, corresponding to cylinder 20, or the matrix may be fiat.

Module 38 in FIG. 1 is one of a row of burner modules which collectively constitutes an IR burner that extends the length of cylinder 20. The burner modules of a row may be aligned as shown, or they may be staggered; e.g., like the squares of a checkerboard, collectively being continuous along the length of the cylinder. That row of modular, sectional burners extends around only an arc of the cylinder's interior 20*b*, the two segments A combined. In cylinders requiring more heat, more rows or wider IR burners may be used than the two rows shown in FIG. 2.

In operation, the web W (FIG. 2) contacts roughly 270° of the cylinder's outer surface 20*a*. Some of the moisture in the web is evaporated during the brief contact period of the web with the cylinder. The degree of drying that takes place depends on the paper web speed and the cylinder temperature.

Many factors determine the temperature of the cylinder, prominently including the efficiency of the cylinder's blackened inner surface 20*b* in absorbing the radiant heat emitted from the IR burner and the efficiency of the IR burner as a generator of infrared radiation. Two main variables determine the cylinder temperature: the width of the burner modules, and the rate of their supply of air-fuel mixture. Burners of the type in the '681 patent and others issued to Thomas M. Smith are operable over a wide range of air-fuel mixture supply rates, resulting in a heat output ratio of 4:1. When the burner surface achieves a maximum temperature, without flame lift-off from the emitter surface, the burner heat output is at a maximum.

The cylinders are ordinarily maintained at their specified maximum temperature when the paper machine is in full operation. It is advantageous to be able to modify the temperature over the full range of control when the machine is being brought up to speed from a cold start and it is particularly helpful when the machine is slowing down. It is desirable to reserve as much of the 4:1 ratio of heat output as possible, for that purpose. Accordingly, the arcuate extent of the IR burner is chosen for a cylinder that is to have a specified maximum temperature at the full operating speed.

It is necessary at times to reduce the maximum temperature attained by a cylinder to a less-than-maximum temperature, as an adjustment. For example, an installed cylinder equipped with its complement of IR burner modules may develop a higher maximum temperature than desired at a particular location in the apparatus. The available cylinder can be adapted to operate at a lower desired peak temperature simply by reducing the peak supply rate of air-fuel mixture. That adjustment detracts from the 4:1 turn-down ratio of the IR burner. This reduction in the available turn-down ratio can be mitigated, and the turn-down can in effect be extended by electronically regulating the "on" times of the burners of some of the cylinders during slowed operation of the paper-making machine.

The maximum temperature of a cylinder heated by IR burners of any particular design and efficiency is directly related to the collective widths or arcuate extents of its IR burners.

Electrically controlled valves 50 (FIGS. 2 and 6) regulate or modulate the supply of air-fuel mixture provided to burner modules 38 from the axial supply tube 28. A whole row of burner modules may be supplied with air-fuel mixture by a common valve 50; or multiple valves may be used for groups of burner modules or individual modules in each row. To special advantage, IR burner modules 38*a* at each end of the cylinder may be somewhat wider than modules 38 or modules 38*a* may differ in other respects from module 38 so as to have a greater heat output per unit of length along the row of modules than module 38 by techniques in the '681 patent. Modules 38 and 38*a* may have separate regulating valves enabling those burner modules to be adjusted separately. That additional heat is to compensate for lessened heat transfer to the cylinder from the end IR burner module 38*a* and for extra heat dissipation and other effects that may occur at the cylinder ends. Using modular or sectional IR burners at the ends of the cylinder as a means for heating the cylinder makes it practical to achieve cylinder-end temperature compensation. The use of separate modules 38 and respective valves 50 and valve controls makes it possible to correct for uneven moisture profiles across the web. In practice, the row of IR burner modules may be made somewhat longer than the cylinder, as one means of compensating for ordinarily declining temperatures at the ends of the cylinder. Accordingly, the phrase "end-to-end" used in relating the row of IR burners to the length of the cylinder should not be read literally.

Sensors have been used to monitor the characteristics of the paper web from point-to-point across the web. Scanning sensors are available, or fixed sensors may be used. For example, see U.S. Pat. No. 5,276,327 issued Jan. 4, 1994 to Bossen et al. Deviations from uniformity can be corrected automatically by using signals from the sensors for selectively controlling the adjustment of the air-fuel mixture supply valves 50 of modules 38 as well as modules 38*a*. Thus, if a sensor were to detect excessive dryness at a margin of the paper web, the valve controlling the rate of air-fuel mixture supplied to the burner modules 38*a* may be adjusted separately for correcting that condition.

Valves 50 may be adjusted collectively—for all of the IR burner modules of a cylinder and for all of the cylinders of a dryer series—when the speed of the apparatus is reduced, as may be needed, to avoid overheating of the web during slowed operation. The hot portions of the IR burners inherently have low thermal inertia and the comparatively thin wall of cylinder 20 also has a relatively small amount of thermal inertia. Accordingly, the temperature change of the cylinder in response to adjustment of its air-fuel supply is rapid. Rapid response of the cylinder to altered operation of its IR burner or burners is extremely valuable, especially in case of emergency stops and sheet breaks. This rapid response to adjustment is an important point of contrast, compared to the slow response of thick-walled cylinders heated by steam under pressure.

Burner modules 38 are part of the stationary structures (FIGS. 1 and 2) inside the cylinder. Structural frame 52 (FIG. 2) unifies the burners and the structural/air-fuel supply tube 28. Exhaust duct 34 is united to transverse panels 54 which, in turn, are united to frame braces 52 and to tube 28. Transverse panels 54 are provided at spaced-apart locations along the length of the cylinder. Tube 28 is the ultimate support of the entire stationary assembly inside cylinder 20.

Figures 4, 6:
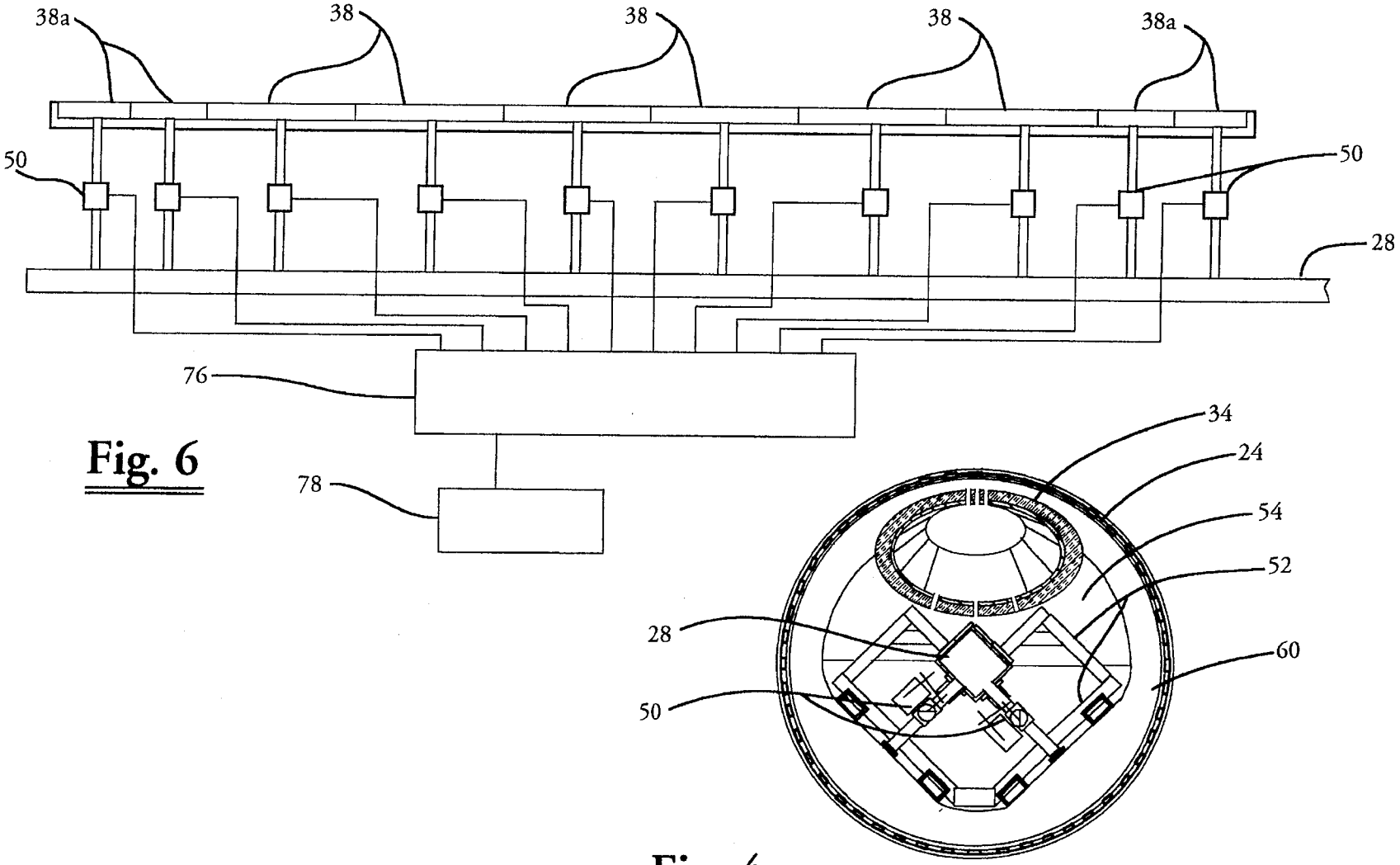
FIG. 4 is another cross-section of the novel cylinder at the plane 4—4 of FIG. 1.
FIG. 6 is a diagrammatic illustration of a row of IR burner modules of the cylinder in FIG. 1 or FIG. 5, with means for controlling the air-fuel supply of each of those modules.

The entire stationary core structure inside the cylinder is removable axially, for repairs or for substitution of IR burner modules of different arcuate extent in case a different maximum temperature should be needed for any particular cylinder. This may be accomplished by initially removing all impediments; i.e., removing frame 27 at the right in FIG. 1 which supports structural tube 28; and removing drive 32, and removing generally annular cover 60 (FIGS. 1 and 4). Several couplings are then disconnected: coupling 61 in the exhaust passage; coupling 63 of the air-fuel supply line; coupling 65 of frame 27 at the left in FIG. 1; and coupling 67 in the exhaust line at the right in FIG. 1. Tube 28 is to be firmly supported at its ends while the various connections are being released; a special sling or a fork-lift may be used to provide such support. Finally, the whole core structure is withdrawn, to the right in FIG. 1, being guided in this motion by suitably supported rod (not shown) extending through the length of tube 28. The details of the cylinder and its inner core structure to facilitate assembly and dis-assembly may be varied extensively by those skilled in the art.

As an alternative the IR burners and their valves and air fuel supply pipes may be fabricated as a unitary assembly, separate from the main support beam 28, exhaust manifold 34, and shield 56*a* and 56*b*. Beam 28 may be used as a support rail and the unitary assembly may have supporting wheels that ride on beam 28. Such alternative assembly is removable from one end of the cylinder. Whether this modification of the core structure or the structure shown is used, the clearance space 58 between the cylinder and the core structure facilitates such removal and replacement of the IR burner assembly. In any case, the heat-isolating structures that separate bearings 22 from the cylinder should not intrude into the path of removal of the core structure from the cylinder.

Figure 2:
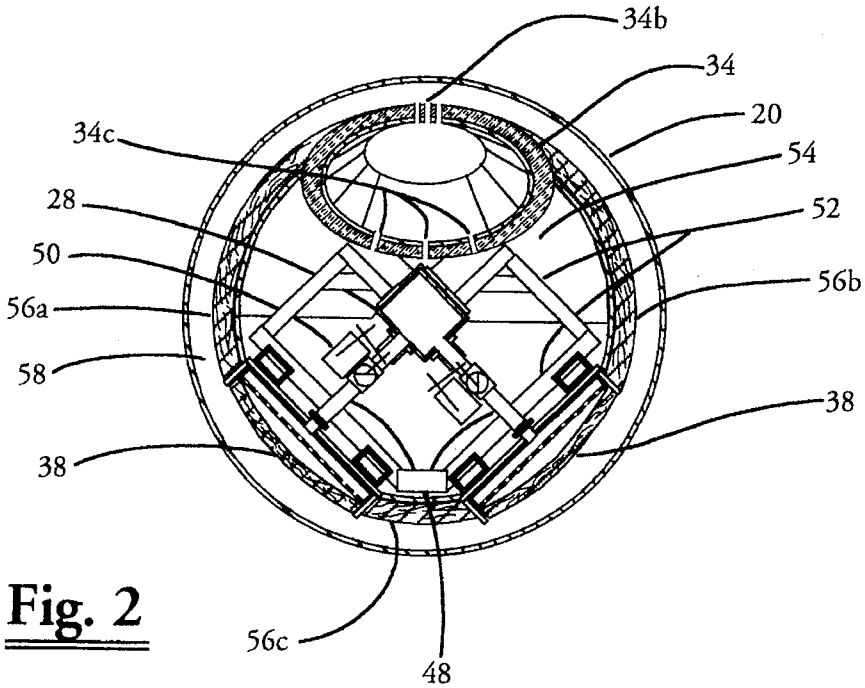
FIG. 2 is a cross-section of the novel dryer cylinder at the plane 2—2 of FIG. 1, FIG. 2 being drawn to a larger scale than FIG. 1.
Figure 1A:
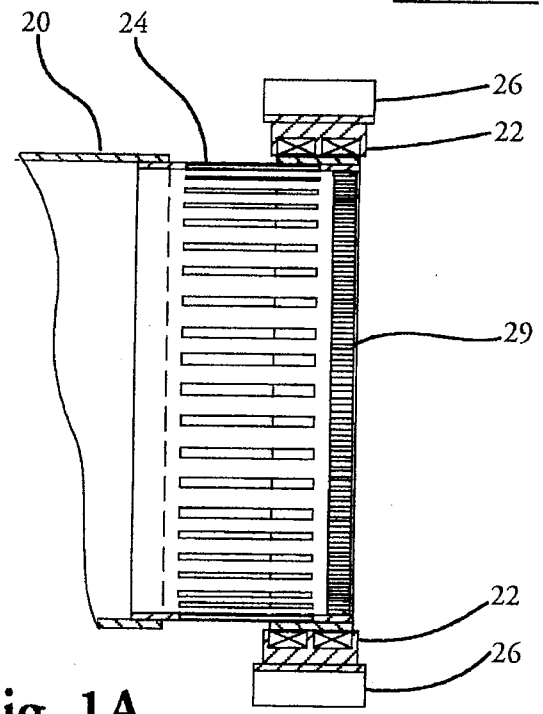
FIG. 1A is a cross-section of the right-hand end portion of the cylinders in FIGS. 1 and 5, omitting stationary apparatus within the cylinder.

Heat radiated by the IR burners is absorbed instantly by that portion of cylinder 20 that is opposite to the burners at any moment. Electrical interlocks, not shown, provide assurance that the IR burners operate only while the cylinder turns. As the cylinder turns, all parts of the cylinder's inner surface pass the IR burners. That inner surface is blackened to promote heat absorption. All parts of the cylinder's wall are uniformly heated, around and along the cylinder. The blackened inner surface inherently acts as a black body; not only does it absorb radiant heat from the IR burners but being hot, it also radiates heat. The reradiated heat could be damaging to the stationary assembly within the cylinder and it would ordinarily be wasteful. Composite heat shield 56*a*, 56*b* and 56*c* (collectively) occupies the gap between the two rows of IR burners in FIG. 2 and two other gaps, between each row of IR burners and the exhaust duct. Those heat shields, for example, are made of fibrous ceramic insulation backed by reinforcing sheet metal. They are united to the exhaust duct, the IR burner modules, and transverse panels 54. FIG. 2 shows two IR burners; i.e., two rows of IR burner modules 38 that extend the length of the cylinder, end-to-end. The combined width (arcuately) of the IR burners is chosen to provide a desired maximum heat output and corresponding maximum cylinder temperature.

Exhaust duct 34 is configured to enable blowers 36 to remove the gaseous products of combustion emitted by the burners in a manner that avoids accumulation of hot exhaust at any location. While most of the heat developed by the IR burners is transformed into radiant heat, the gaseous products of combustion are also hot. Any accumulation of hot exhaust that might interfere with the temperature uniformity of cylinder 20 along its length should be avoided.

It may be noted that the exhaust gas is relatively clean. It is reusable elsewhere, as in the drying section, for even higher drying energy efficiency.

The gaseous products of combustion have very strong buoyancy because they are quite hot; they rise rapidly in the space 58 between the cylinder 20 and the stationary composite shield 56*a*, 56*b*, and 56*c* within the cylinder. A portion of the heat from the rising gases is transferred to the inner surface of the cylinder, adding to the heat absorbed by the blackened inner surface of the cylinder. Some clearance between the cylinder and the burner modules 38, and some clearance between the cylinder and all the heat shields are a mechanical necessity but it is not a critical dimension. A clearance space of 102 mm to 152 mm (4" to 6") between the cylinder and the stationary assembly is appropriate. The exhaust gas from burner modules 38 rises rapidly in that clearance space to duct 34. Holes or slots 34*b* in the top of the duct admit the exhaust into the duct for removal by blowers 36.

In FIG. 1, the cross-section of duct 34 increases from a minimum midway along cylinder 20 to the exhaust exits 34*a* at the opposite ends of the cylinder. Exhaust emitted by burner modules 38 which are located midway along the cylinder, enters the duct midway along the cylinder. That exhaust is drawn to exhaust exits 34*a* of the duct. Exhaust from other burner modules at locations progressively closer to the exhaust exits 34*a* enters the duct at points correspondingly closer to ends of the cylinder. The progressive enlargement of the duct's cross-section promotes uniform exhaust removal. The apertures 34*b* are also of a configuration promoting uniform exhaust removal. To that end, if apertures 34*b* are slots, they are progressively wider in accordance with their proximity to the closer one of the two exhaust exits 34*a* of the duct. If the apertures are holes, they are larger and/or more numerous with decreasing distance from the closer one of two exhaust exits 34*a* of the duct. The varied cross-sectional area of the duct and the varied duct openings that admit the exhaust into the duct act variously to impede the flow of the gaseous exhaust, so as to equalize flow rates of exhaust into and along duct 34.

Alternatively, a duct of uniform cross-section may be used, provided that the pattern and sizes of apertures 34*b* are proportioned to progressively impede the flow of exhaust.

Duct 34 also has openings 34*c* for admitting air from the cylinder's internal volume, to avoid a build-up of heat in that region. Annular cover 60 in FIG. 4 advantageously forms a barrier at the end of exhaust space 58 at each end of the cylinder. Barrier 60 is fixed to the stationary assembly inside the cylinder. Air may enter the cylinder's interior through the open area of cover 60 at both of the cylinder's ends to make up for air that leaves the interior via openings 34*c*.

Duct 34 in FIG. 1 extends from the midpoint of the cylinder to exhaust ends 34*a* of the duct and to corresponding blowers 36. A barrier across duct 34 may be provided at its midpoint if desired.

While no ignition means is shown in the drawings, it should be understood that conventional ignition devices such as a pilot burner or burners, or electric ignition devices will be incorporated in the stationary structure, at suitable places.

Figure 5:
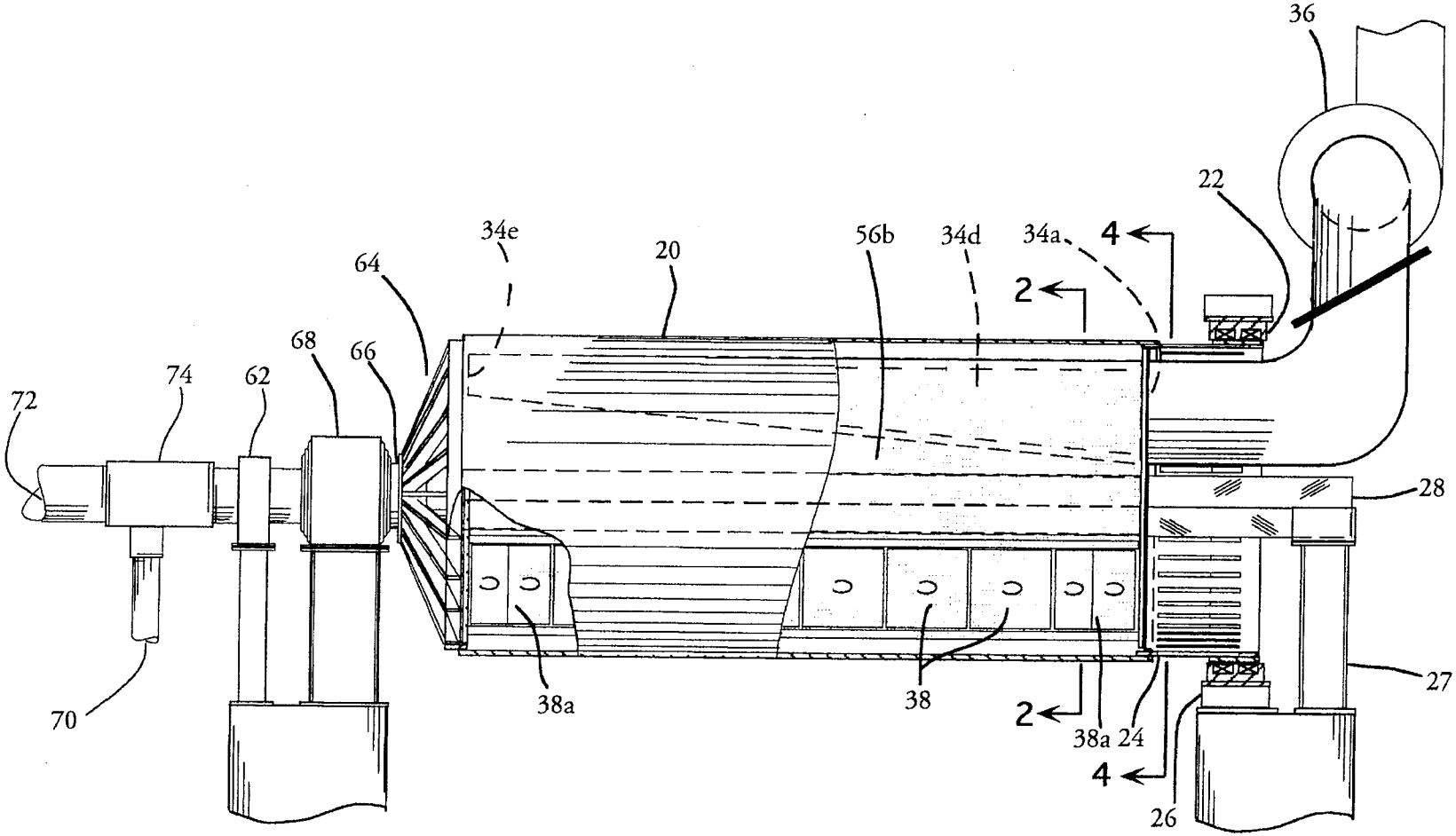
FIG. 5 is a modification of FIG. 1.

FIG. 5 is essentially a replica of FIG. 1; the same reference numerals are used for the same parts. The difference between FIGS. 1 and 5 is that the exhaust duct 34*d* in FIG. 5 has only one exhaust exit 34*a* and the bearing structure at the left extremity in FIG. 5 is simplified. The cross-section of exhaust manifold 34*d* increases progressively from end 34*e* to the exhaust end 34*a*.

In FIG. 5, structural tube 28 is carried by a fixed support 62. Cylinder 20 is supported by a heat-isolation collar 64, whose inner ends extend from journal 66. Bearing 68 supports journal 66 rotatably. Gaseous fuel is admitted to tube 28 by gas line 70 and mixing valve 74; air is admitted via tube 72 to mixing valve 74. (This air-fuel mixture supply arrangement may be used in FIG. 1)

The form of apparatus of FIG. 5 is preferred over that of FIG. 1 for use where the length of the cylinder is small enough to function with an exhaust duct 34*d* that has only one exhaust end 34*a*.

Each of the two IR burners shown in FIG. 2 is a composite of multiple modules extending along and inside of cylinder 20. There is a distinct advantage of subdividing the IR burners into burner modules. As shown in FIG. 6, each module 38 may have its own valve 50 regulating its supply of air-fuel mixture. An electrical control 76 controls each valve 50, or in an alternative, control 76 may operate multiple valves 50. For example, the valves 50 that control the supply of air-fuel mixture to modules 38*a* at the ends of the cylinder serve to control the moisture content of the paper web at its margins, so that it may be satisfactory to use a common control 76 to regulate the air-fuel mixture supplied to both modules 38*a*. Sensor 78 may be the same as that in U.S. Pat. No. 5,276,327 (supra), or sensor 78 in the drawing may represent a succession of stationary sensors, cooperating with the paper web as it leaves the cylinder whose valves 50 are sensor-controlled, one for each burner module 38. Sensor 78 in either form controls the regulation of each valve 50 or judiciously selected valves 50 so as to increase or decrease the heat output of the cylinder opposite each burner module 38.

The illustrative embodiments of the invention shown in the drawings incorporate various novel features, some of which may be omitted, together with their function, while other novel features and their advantages are retained. Additional modifications of the illustrative embodiments as shown may be adopted by those skilled in the art within the spirit and scope of the invention. Consequently, the invention should be construed broadly, in accordance with its true spirit and scope.

I claim:

1. Apparatus for heat-treating webs, including a cylinder mounted for rotation about a horizontal axis and having an outer web-engaging surface and an inner prominently heat-absorbing surface, a drive for rotating the cylinder, and a stationary structure within the cylinder including an IR burner complement which has a combustion surface that is characteristically incandescent when in operation, said combustion surface confronting but being separated by an exhaust-gas receiving space from said inner heat-absorbing surface and extending essentially end-to-end of said inner surface of the cylinder lengthwise but the area of said combustion surface being limited so as to confront substantially less than the area of said heat-absorbing inner surface, only that portion of the cylinder's inner surface which is confronted by said combustion area being heated thereby instantaneously, all of the cylinder's inner surface being heated by radiation from said combustion area during continued rotation of the cylinder.

2. Apparatus as in claim 1, wherein said IR burner complement includes sectional IR burner modules confronting mutually remote end portions of the inner surface of the cylinder, said sectional IR burner modules being adapted to emit more heat per unit of length measured along the cylinder than the remainder of said IR burner complement for enhanced heating of the margins of the web by the end portions of the cylinder.

3. Apparatus as in claim 2, further including in said stationary structure separately regulated passages for supplying air-fuel mixture to those sectional IR burner modules whose combustion area confronts said mutually remote end portions of the cylinder.

4. Apparatus for heat-treating webs as in claim 1, wherein said IR burner comprises a succession of burner complement modules distributed essentially along the length of the cylinder, means for sensing the moisture profile of the web across its width, and supply-modulating valves responsive to said sensing means for regulating the supply of air-fuel mixture to said modules as may be appropriate, for adjusting the transverse moisture profile of the paper web.

5. Apparatus as in claim 1, further including in said stationary structure an exhaust duct adapted to admit exhaust gas from said exhaust-gas receiving space and to discharge exhaust gas endwise of the cylinder, the limited area of said combustion surface, providing an arcuate gap within which said exhaust duct is disposed, said exhaust duct extending along said cylinder and being spaced from said inner heat-absorbing surface.

6. Apparatus as in claim 5, wherein said exhaust duct has means for providing impedance to the flow of the exhaust gas from within the cylinder into and along the duct, the impedance varying so as to equalize the mass rate of discharge of exhaust gas into the duct from point-to-point along its length.

7. Apparatus as in claim 5, wherein there are arcuate gaps between said exhaust manifold and said IR burner, and wherein heat-reradiating shields are disposed in said gaps and confront said heat-absorbing surface of the cylinder.

8. Apparatus as in claim 5, wherein said duct comprises means for providing impedance to the flow of the exhaust gas into and along the duct, said impedance varying along the duct in such manner as to equalize the mass rate of flow of the exhaust gas into and along the duct.

9. Apparatus as in claim 1, further including an elongated exhaust duct above the axis of the cylinder, within and along the cylinder extending from a position between mutually opposite ends of the cylinder to exhaust exits at opposite ends of the exhaust duct.

10. Apparatus as in claim 9, wherein the cross-sectional area of the duct increases progressively from said position to each of its opposite ends.

11. Apparatus as in claim 1, wherein said stationary structure includes shielding means confronting said heat-absorbing surface for intercepting heat from such heat-absorbing surface that otherwise would radiate into the interior of the cylinder.

12. Apparatus as in claim 1, wherein the periphery of said stationary structure includes an arcuate gap unoccupied by the IR burner complement, said stationary structure further including an elongated exhaust duct in said gap extending along the cylinder but spaced therefrom, said exhaust duct having passage means distributed along the exhaust duct for admitting exhaust gas from said exhaust space into the duct, and means for drawing exhaust gas endwise out of the duct.

13. Apparatus as in claim 12, wherein said IR burner complement and said exhaust duct intercept heat radiated inward by said heat-absorbing inner surface of said cylinder, said stationary structure additionally having a barrier that supplements said IR burner complement and said exhaust duct for intercepting heat radiated inward by said heat-absorbing inner surface of the cylinder.

14. Apparatus as in claim 12, wherein said exhaust duct has passage means for admitting air from within the stationary structure, for preventing overheating of the interior of said stationary structure.

15. Apparatus as in claim 1, wherein there is a gap in the periphery of said stationary structure unoccupied by said combustion area, and wherein said stationary structure includes heat shielding means in said gap acting to obstruct heat that is radiated inward by said inner heat-absorbing surface of the cylinder when, in the operation of the apparatus, said heat-absorbing surface is heated.

16. Apparatus as in claim 15, wherein heat shielding means has a prominently heat-absorbing and heat-reradiating surface confronting said heat-absorbing inner surface of the cylinder.

17. Apparatus as in claim 1, wherein said IR burner complement includes many IR burner modules distributed lengthwise of the cylinder, many of said modules having respective adjustable means for regulating their supply of air-fuel mixture for thereby regulating the cross-machine profile of heat-treatment of the web.

18. Apparatus as in claim 17, further including means for sensing the cross-machine profile of the web, said adjustable means being responsive to said sensing means.

19. Apparatus for heat-treating webs, including a cylinder mounted for rotation about a horizontal axis, having an outer web-engaging surface and an inner prominently heat-absorbing surface, and a stationary structure within the cylinder comprising a complement of IR burners that includes at least one IR burner, said complement of IR burners having combustion area confronting but spaced freon said inner heat-absorbing surface, the combustion area being incandescent when in operation, said complement of IR burners extending essentially from end-to-end of said cylinder and confronting only a cylindrical segment of said heat-absorbing surface, an elongated exhaust duct at the top of said cylinder but separated from said heat-absorbing surface by exhaust duct clearance space, said exhaust duct extending along and within said cylinder and being formed for admitting exhaust gas from said exhaust duct clearance space, and shielding means coacting with said heat-absorbing surface to guide hot exhaust gas from said complement of IR burners to said exhaust duct, said shielding means acting with said complement of IR burners and said exhaust duct for providing heat protection for the stationary structure within the cylinder.

20. A method of heat-treating a web that traverses a path partway around and in contact with a heated rotating cylinder, wherein the cylinder is heated by an internal stationary complement of IR burners extending end-to-end in the cylinder and whose extent around the cylinder is limited to have a predetermined limited capacity of delivering heat to the web via the cylinder when the rate of supply of air-fuel mixture to the IR burner complement is at least near maximum, i.e., flame lift-off rate, said method including the steps of rotating the cylinder at a routine maximum rate for thereby heat-treating the web at a routine maximum rate while the cylinder is contacted by the web and while the complement of IR burners is being supplied with air-fuel mixture at least near said maximum rate, and reducing the speed of the web and of cylinder rotation while progressively reducing the rate of air-fuel mixture supply to the complement of IR burners through a turn-down range from said at-least near maximum rate to the minimum rate that supports combustion.

21. A method of producing a cylinder for imparting heat to a web, including the steps of mounting an IR burner complement stationary within a rotary cylinder and extending in confrontation with the inner surface of the cylinder from end-to-end thereof, the IR burner complement being of the type that characteristically emits radiant heat when in operation and whose maximum rate of heat emission is limited by the maximum rate of supply of air-fuel mixture that sustains operation without flame lift-off, and establishing the combustion area of the IR burner complement at substantially less than said inner area of the cylinder in accordance with the rate of heat to be imparted to the web when the cylinder is in full-speed operation and when the IR burner complement is operating at least near its maximum supply rate.

* * * * *